United States Patent [19]

Zaita

[11] Patent Number: 4,464,312

[45] Date of Patent: Aug. 7, 1984

[54] CARBURETOR FOR INTERNAL COMBUSTION ENGINES

[75] Inventor: Katsuyuki Zaita, Kawagoe, Japan

[73] Assignee: Honda Giken Kogyo Kabushiki Kaisha, Tokyo, Japan

[21] Appl. No.: 397,369

[22] Filed: Jul. 12, 1982

[30] Foreign Application Priority Data

Jul. 10, 1981 [JP] Japan ..... 56-107108

[51] Int. Cl.[3] ..... F02M 5/02

[52] U.S. Cl. ..... 261/70; 261/72 R; 261/DIG. 50

[58] Field of Search ..... 261/DIG. 50, DIG. 2, 261/70, 72 R

[56] References Cited

U.S. PATENT DOCUMENTS

| | | | |
|---|---|---|---|
| 1,823,017 | 9/1931 | Wolfard | 261/70 |
| 2,149,116 | 2/1939 | Dicke | 261/DIG. 50 |
| 2,168,718 | 8/1939 | Scaife | 261/70 |
| 2,202,993 | 6/1940 | Mollberg | 261/70 |
| 2,757,914 | 8/1956 | Ball | 261/DIG. 50 |
| 2,766,025 | 10/1956 | Higgins, Jr. | 261/DIG. 50 |
| 3,376,026 | 4/1968 | Fisher | 261/70 |
| 4,041,112 | 8/1977 | Nakamura et al. | 261/DIG. 50 |
| 4,383,952 | 5/1983 | Montefameglio et al. | 261/DIG. 50 |

*Primary Examiner*—Tim R. Miles

*Attorney, Agent, or Firm*—Armstrong, Nikaido, Marmelstein & Kubovcik

[57] ABSTRACT

A carburetor for internal combustion engines, comprising an intake cylinder having an intake passage, a float chamber projecting from a lower side of the intake cylinder and capable of being filled with a fuel, floats provided in the float chamber for vertical movement in accordance with the change in the level of the surface of the fuel therein, a float valve adapted to open and close in accordance with the movements of the floats to maintain the fuel surface at a predetermined level, and a fuel passage for introducing the fuel in the float chamber into the intake passage, wherein that portion of the fuel passage which extends into the float chamber is inclined with respect to the axis of the intake passage, the floats are movable in parallel with the axis of the mentioned portion of the fuel passage, which extends into the float chamber, in accordance with the change of the level of the fuel surface in the float chamber.

4 Claims, 4 Drawing Figures

CARBURETOR FOR INTERNAL COMBUSTION ENGINES

BACKGROUND OF THE INVENTION

1. Field of the Invention

This invention relates to a carburetor to be applied to engines for vehicles, mainly motorcycles, and more particularly to a carburetor for internal combustion engines, including an intake cylinder having an intake passage, a float chamber projecting from a lower side of the intake cylinder and capable of being filled with a fuel, floats provided in the float chamber for vertical movement in accordance with the change of the surface level of the fuel therein, a float valve adapted to open and close in accordance with the movements of the floats to maintain the fuel surface at a predetermined level, and a fuel passage means for introducing the fuel in the float chamber into the intake passage.

2. Description of the Prior Art

Conventional carburetors of this kind include a horizontal type one, in which an intake cylinder is disposed substantially in a horizontal direction, and a vertical type one, in which an intake cylinder is disposed substantially in a vertical direction. In the horizontal type carburetor, a float chamber is so formed that the center line thereof is substantially at right angles to the axis of the intake passage. In the vertical type carburetor, a float chamber is so formed that the center line thereof is substantially parallel to the axis of the intake passage. In any of these horizontal and vertical types of carburetors, that portion of a fuel passage means which extends into the float chamber runs almost in the vertical direction along the center line of the float chamber, and a float is adapted to move along the same center line. When the intake cylinder in any of these carburetors is disposed in such a manner that the axis of the intake passage is inclined at a large angle, for example, not less than 15° with respect to a horizontal or vertical plane, that portion of the fuel passage means which extends into the float chamber is also inclined greatly with respect to a vertical plane. Accordingly, the level of the surface of the fuel in the float chamber is also varied greatly. This causes variations in the lift of the fuel from the surface of the fuel in the float chamber to the intake passage, and also in the fuel feed characteristics. Therefore, the arrangement of the intake cylinder in the above-mentioned manner is not preferable. Accordingly, in order to prevent the inconveniences referred to above, it is required that the carburetor be disposed in such a manner that the axis of the intake passage is inclined at a small angle, for example, within 15°, with respect to a horizontal or vertical plane. Thus, when any of these conventional carburetors is used for a vehicle engine, the disposition of the engine and the construction of the vehicle are restricted greatly.

SUMMARY OF THE INVENTION

An object of the present invention is to provide a carburetor for internal combustion engines of the kind mentioned at the opening paragraphs, which is usable without encountering any troubles even when an intake cylinder is disposed in such a manner that the axis of an intake passage is inclined at any angle in the range of 0°–90° with respect to a horizontal or vertical plane.

In order to achieve the above object, in accordance with the present invention, that portion of the fuel passage means which extends into the float chamber is inclined with respect to the axis of the intake passage and the float is so disposed that it can be moved parallel to the axis of the mentioned portion of the fuel passage means in response to the change in the level of the fuel in the float chamber.

The above and other objects, features and advantages of the invention will become apparent from the following detailed description of a preferred embodiment when taken in conjunction with the accompanying drawings.

DESCRIPTION OF THE PREFERRED EMBODIMENT

Figure 1:
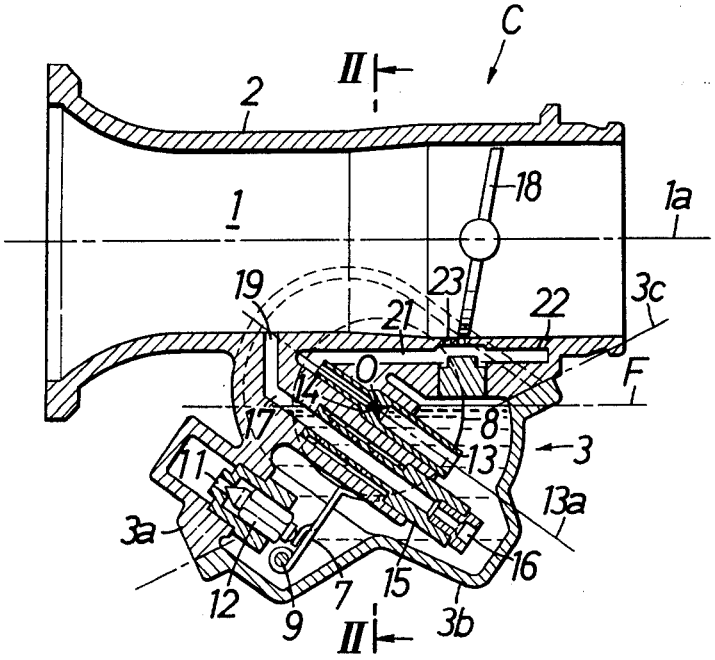
FIG. 1 is a side elevational view in longitudinal section of a carburetor according to the present invention.
Figure 2:
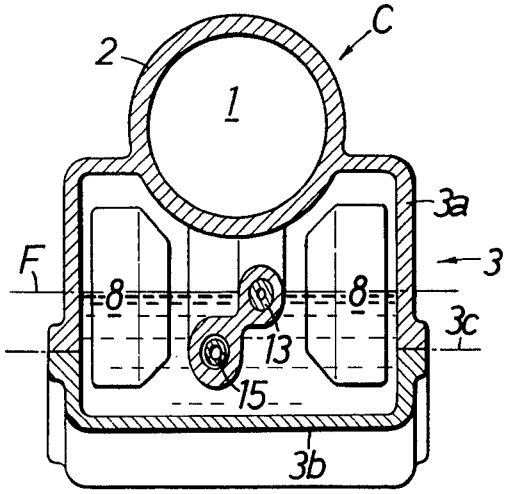
FIG. 2 is a sectional view taken along the line II—II in FIG. 1.

An embodiment of the present invention will now be described with reference to the drawings. FIG. 1 shows a carburetor C to be applied to internal combustion engines for vehicles, such as motorcycles. The carburetor C has therein an intake cylinder 2, which defines an intake passage 1 connected to an intake system (not shown) for an internal combustion engine, and a float chamber 3 provided at one side of the intake cylinder 2. The carburetor C shown in FIG. 1 is disposed horizontally, i.e. in such a manner that an axis 1*a* of the intake passage 1 extends horizontally.

The float chamber 3 comprises a float chamber body 3*a*, which is formed unitarily with a lower portion of the intake cylinder 2, and which is opened at a lower side thereof, and a lower cover 3*b* joined to a lower surface of the opened side of the float chamber body 3*a*. A joint surface 3*c* of the float chamber body 3*a* and lower cover 3*b* is inclined with respect to the axis 1*a* of the intake passage 1.

The float chamber 3 houses therein a pair of right and left floats 8 connected together via a pivotable arm 7, which is supported on a shaft 9 in such a manner that the arm 7 can be moved pivotally in the vertical direction. A fuel inlet port 11 is opened at the lower side of the float chamber body 3*a* , in which a float valve 12 is provided for opening and closing the fuel inlet port 11 in accordance with the vertical movement of the pivotable arm 7. Accordingly, when the fuel in the float chamber 3 is consumed and the level of the surface thereof lowers, the float 8 moves downward accordingly to open the float valve 12, and allow the fuel in a fuel tank (not shown) to be supplied into the float chamber 3 through the inlet port 11. Thus, the surface of the oil in the float chamber 3 can be kept constantly at a predetermined level. As is shown in FIG. 1, the surface of the fuel in the float chamber 3 is designated by "F", and the center of the surface of the fuel oil, i.e. a point, by "0", in which the fuel level is not varied even when the surface F is inclined. The pair of floats 8 are shaped like a cylinder or a frusto-cone or a composite of them. The floats are designed so that when they float on the fuel surface F the draft passes through the center of each float. Further, the floats are positioned so that the middle point of the distance between the floats lies at the center of the surface of the fuel. Thus, even if the surface of the fuel slants to the front or back or to the right or left, the floats do not move up and down, and can only be moved in response to the change of the substantial fuel level.

In the float chamber 3, a low speed fuel pipe 13 having a slow jet 14, and a main fuel pipe 15 having a main jet 16, are inclined with respect to the axis 1*a* of the intake passage 1. In the embodiment shown in the drawings, the pipes are positioned at an angle of about 35°. In this case, in particular, the low speed fuel pipe 13 is positioned so that its axis 13*a* substantially passes through the center of the fuel surface.

The main fuel pipe 15 is disposed parallel to the low-speed fuel pipe 13, and as close as possible to the center O of the oil surface in the float chamber 3. Accordingly, the float 8 is moved parallel to the axis 13*a* of the low speed fuel pipe 13 in the vicinity of the center O in response to variations in the level of the oil surface. The main fuel pipe 15 is connected at an upper end thereof via a fuel passage 17 to a main nozzle 19, which is opened into that portion of the intake passage 1 which is on the upstream side of a throttle valve 18. The main nozzle 19 is disposed substantially at right angles to the intake passage 1.

The low-speed fuel pipe 13 is connected at an upper end thereof via a fuel passage 21 to an idle port 22 and a by-pass port 23, which are opened into those portions of the intake passage 1 which are on the downstream side of the throttle valve 18. The fuel passage 21 first extends upward from the low-speed fuel pipe 13 to be bent at the back of the main nozzle 19, and further extends parallel to the axis 1*a* of the intake passage 1.

Figure 3:
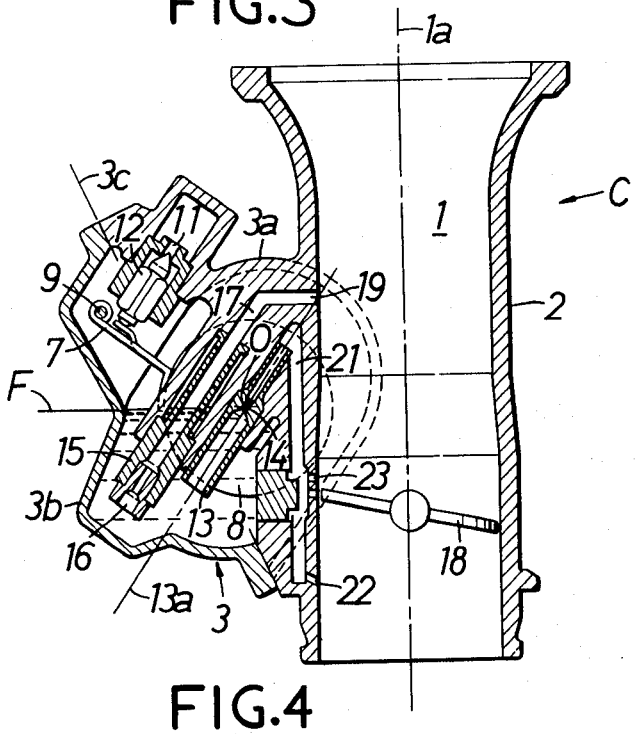
FIGS. 3 and 4 illustrate different modes of practical use of the carburetor shown in FIG. 1.
Figure 4:
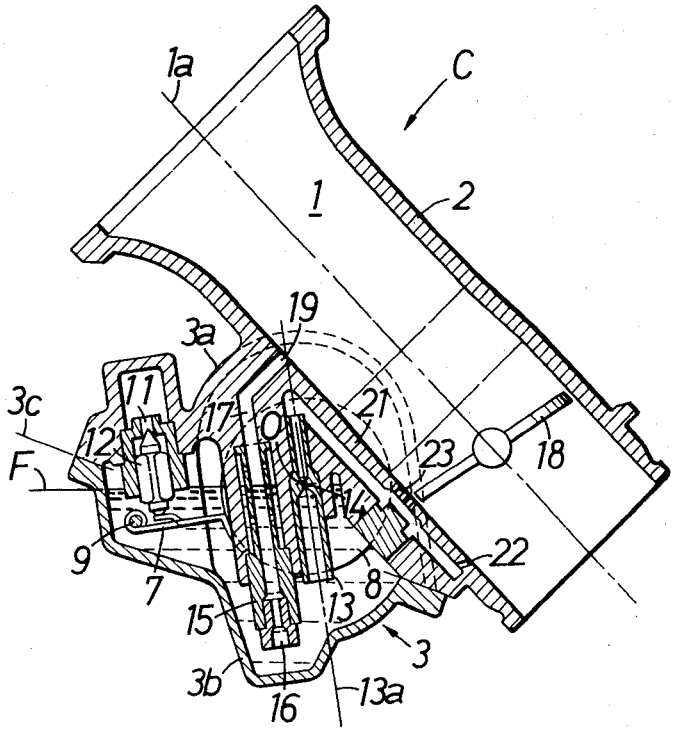

The carburetor C according to the present invention, constructed in the manner described above, is used as a horizontal type carburetor as shown in FIG. 1 in which the intake cylinder 2 extends substantially in a horizontal direction, or as a vertical type carburetor as shown in FIG. 3 in which the intake cylinder extends substantially in a vertical direction, or as a diagonal type carburetor as shown in FIG. 4 in which the intake cylinder is inclined at an angle between horizontal and vertical planes. In any of these modes of use of the carburetor, the oil levels, i.e. the heights of the oil surfaces within the low-speed fuel pipe 13 and main fuel pipe 15, which are disposed in the vicinity of the center O of the oil surface in the float chamber 3, are maintained substantially at a constant level, respectively, by appropriate auxiliary supply of fuel through the float valve 12. Accordingly, the lengths of fuel passages between the oil surfaces in the low-speed fuel pipe 13 and the intake passage 1, i.e. the lift of the fuel in the fuel pipe 13 is not varied. This allows the fuel to be fed to the intake passage 1 stably, and enables to prevent the fuel from flowing unexpectedly from the float chamber 3 to the intake passage 1.

In accordance with the present invention as has been described above, the carburator can be disposed with the intake cylinder extending horizontally, vertically or diagonally. Namely, it can be used as any of horizontal, vertical or diagonal type and furthermore can be operated in a favourable condition in any of these modes of use. Therefore, the carburetor according to the invention can be mass-produced in a very economical manner as compared with conventional ones of this kind which have to be manufactured in different designs in order to meet respective modes of use as mentioned above.

The present invention is not, of course, limited to the above embodiment; it may be modified in various ways within the scope of the appended claims.

What is claimed is:

1. In an improved carburetor for internal combustion engines, including an intake cylinder having an intake passage therein, a float chamber projecting sidewardly from said intake cylinder and capable of being filled with fuel therein, a float member provided in said float chamber and adapted to be displaced in accordance with the change in the surface level of the fuel therein, a float valve operatively connected with said float member to open and close in response to displacements of the float member to maintain the fuel surface at a constent level, and a main fuel passage and a low-speed fuel passage adapted to introduce the fuel in the float chamber into said intake passage, respectively, the improvement wherein said main and low-speed fuel passages are inclined with respect to the axis of said intake passage and arise from below the surface of fuel in the float chamber, said float member is arranged to be displaceable in a direction parallel with the axis of said low-speed fuel passage, and the center of the surface of fuel in said float chamber is located substantially on the axis of said low-speed fuel passage.

2. A carburetor as set forth in claim 1, wherein said fuel passage means further includes a main fuel passage having a main fuel pipe extending into said float chamber, said main fuel pipe being disposed parallel to said low-speed fuel pipe and as close as possible to the center of the fuel surface in said float chamber.

3. A carburetor as set forth in claim 2, wherein said main fuel passage has a main nozzle opened into said intake passage at a position upstream of a throttle valve, said main nozzle extending at right angles to the axis of said intake passage.

4. A carburetor as set forth in any of claims 1, 2 or 3, said intake cylinder is disposed in such a manner that the axis of said intake passage is inclined with respect to a horizontal plane, said float chamber comprising a float chamber body formed unitarily with a lower portion of said intake cylinder and a lower cover joined to a lower surface of said float chamber body, a joint surface between said float chamber body and said lower cover being inclined with respect to a horizontal plane at an angle smaller than that of inclination of said intake cylinder with respect to the horizontal plane.

* * * * *